US010394150B2

(12) United States Patent
Komada

(10) Patent No.: US 10,394,150 B2
(45) Date of Patent: Aug. 27, 2019

(54) POSITIVELY CHARGEABLE TONER

(71) Applicant: KYOCERA Document Solutions Inc., Osaka (JP)

(72) Inventor: Ryotaro Komada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/153,882

(22) Filed: Oct. 8, 2018

(65) Prior Publication Data

US 2019/0121252 A1 Apr. 25, 2019

(30) Foreign Application Priority Data

Oct. 20, 2017 (JP) ..... 2017-203623

(51) Int. Cl.
*G03G 9/093* (2006.01)
*G03G 9/097* (2006.01)

(52) U.S. Cl.
CPC ..... *G03G 9/09321* (2013.01); *G03G 9/09342* (2013.01); *G03G 9/09364* (2013.01); *G03G 9/09371* (2013.01); *G03G 9/09392* (2013.01); *G03G 9/09716* (2013.01); *G03G 9/09725* (2013.01)

(58) Field of Classification Search
CPC ..... G03G 9/09342; G03G 9/09321; G03G 9/09371; G03G 9/09725; G03G 9/09716
See application file for complete search history.

(56) References Cited

U.S. PATENT DOCUMENTS 9,158,218 B2 * 10/2015 Tsujihiro ..... G03G 9/1135
10,126,670 B2 * 11/2018 Tanaka ..... G03G 9/09342
2010/0009277 A1 * 1/2010 Ogawa ..... B82Y 30/00 430/108.7
2017/0248860 A1 * 8/2017 Nishitera ..... G03G 9/0819

FOREIGN PATENT DOCUMENTS

JP 62262056 A * 11/1987 ..... G03G 9/09307
JP 2005-321690 A 11/2005

* cited by examiner

*Primary Examiner* — Christopher D Rodee
(74) *Attorney, Agent, or Firm* — Studebaker & Brackett PC

(57) ABSTRACT

A positively chargeable toner includes a plurality of toner particles. The toner particles each include a toner mother particle and an external additive. The toner mother particle includes a toner core containing a binder resin and a shell layer covering a surface of the toner core. The external additive includes a plurality of silica particles. The silica particles are each present on a surface of the shell layer and include a silica base having a surface treated with a surface treatment agent. The surface treatment agent includes a first treatment agent having a carboxyl group in a molecule thereof. The toner core and each of the silica particles is bonded to each other through a specific covalent bond. An amount of ring-unopened oxazoline groups included in 1 g of the positively chargeable toner as measured by gas chromatography-mass spectrometry is at least 0.10 μmol and no greater than 100 μmol.

10 Claims, No Drawings

POSITIVELY CHARGEABLE TONER

INCORPORATION BY REFERENCE

The present application claims priority under 35 U.S.C. § 119 to Japanese Patent Application No. 2017-203623, filed on Oct. 20, 2017. The contents of this application are incorporated herein by reference in their entirety.

BACKGROUND

The present disclosure relates to a positively chargeable toner.

Use of silica particles subjected to a treatment for imparting hydrophobicity and a treatment for imparting positive chargeability as external additive particles is proposed.

SUMMARY

A positively chargeable toner according to the present disclosure includes a plurality of toner particles. Each of the toner particles includes a toner mother particle and an external additive. The toner mother particle includes a toner core containing a binder resin and a shell layer covering a surface of the toner core. The external additive includes a plurality of silica particles. Each of the silica particles is present on a surface of the shell layer and includes a silica base having a surface treated with a surface treatment agent. The surface treatment agent includes a first treatment agent having a carboxyl group in a molecule thereof. The toner core and each of the silica particles are bonded to each other through a covalent bond within the shell layer. The covalent bond includes a first amide bond and a second amide bond. The shell layer contains a vinyl resin. The vinyl resin includes a constitutional unit represented by formula (1-1) shown below, a constitutional unit represented by formula (1-2) shown below, and a constitutional unit represented by formula (1-3) shown below. An amide bond included in the constitutional unit represented by formula (1-1) is the first amide bond. An amide bond included in the constitutional unit represented by formula (1-2) is the second amide bond. An amount of ring-unopened oxazoline groups included in 1 g of the positively chargeable toner as measured by gas chromatography-mass spectrometry is at least 0.10 μmol and no greater than 100 μmol.

(1-1)

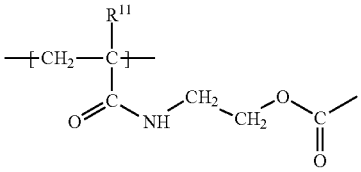

In formula (1-1), $R^{11}$ represents a hydrogen atom or an alkyl group optionally substituted with a substituent. In formula (1-1), an available bond of a carbon atom bonded to two oxygen atoms is connected to an atom of the binder resin.

(1-2)

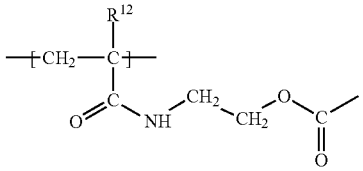

In formula (1-2), $R^{12}$ represents a hydrogen atom or an alkyl group optionally substituted with a substituent. In formula (1-2), an available bond of a carbon atom bonded to two oxygen atoms is connected to an atom of the first treatment agent.

(1-3)

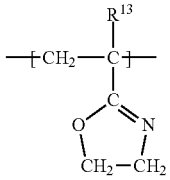

In formula (1-3), $R^{13}$ represents a hydrogen atom or an alkyl group optionally substituted with a substituent.

DETAILED DESCRIPTION

The following describes an embodiment of the present disclosure. Note that evaluation results (values indicating shape, physical properties, or the like) for particles are number averages of values measured for an appropriate number of particles selected from among the particles of interest, unless otherwise stated. Examples of a mass of particles include toner mother particles, an external additive, and a toner. The term toner mother particle refers to a toner particle including no external additive.

A number average particle diameter of particles is a number average value of equivalent circle diameters of primary particles (diameters of circles having the same areas as projected areas of the particles) measured using a microscope, unless otherwise stated. A measured value for a volume median diameter ($D_{50}$) of particles is a value measured based on the Coulter principle (electrical sensing zone method) using "COULTER COUNTER MULTISIZER 3" manufactured by Beckman Coulter, Inc., unless otherwise stated.

Measured values for an acid value and a hydroxyl value are values measured in accordance with "Japanese Industrial Standard (JIS) K0070-1992", unless otherwise stated. Measured values for a number average molecular weight (Mn) and a mass average molecular weight (Mw) are values measured by gel permeation chromatography, unless otherwise stated. A glass transition point (Tg) and a melting point (Mp) are values measured using a differential scanning calorimeter ("DSC-6220" manufactured by Seiko Instruments Inc.), unless otherwise stated. A softening point (Tm) is a value measured using a capillary rheometer ("CFT-500D" manufactured by Shimadzu Corporation), unless otherwise stated.

In the following description, the term "-based" may be appended to the name of a chemical compound in order to form a generic name encompassing both the chemical compound itself and derivatives thereof. When the term "-based"

is appended to the name of a chemical compound used in the name of a polymer, the term indicates that a constitutional unit of the polymer originates from the chemical compound or a derivative thereof. The term "(meth)acryl" may be used as a generic term encompassing both acryl and methacryl.

Chargeability refers to chargeability in triboelectric charging, unless otherwise stated. A toner can be triboelectrically charged through mixing and stirring with a standard carrier (anionic property: N-01, cationic property: P-01) provided by The Imaging Society of Japan, for example. A surface potential of a toner particle is measured before and after triboelectric charging using for example a kelvin probe force microscope (KFM). A portion where the electric potential changes by a larger amount between before and after the triboelectric charging has stronger chargeability.

A positively chargeable toner excellent in charge stability means a positively chargeable toner having the following first through third characteristics. The first characteristic is that the positively chargeable toner has a sharp charge amount distribution. The second characteristic is that an amount of charge of the positively chargeable toner can be maintained at a desired amount of charge before image formation using the positively chargeable toner is started. The third characteristic is that an amount of charge of the positively chargeable toner can be maintained at a desired amount of charge when continuous image formation is performed using the positively chargeable toner.

A positively chargeable toner according to the present embodiment is an electrostatic latent image developing toner suitably usable for development of electrostatic latent images. The positively chargeable toner according to the present embodiment may constitute a one-component developer, or may compose a two-component developer together with a carrier. When the positively chargeable toner constitutes a one-component developer, the positively chargeable toner is positively charged through friction with a development sleeve or a toner charging member in a development device. An example of the toner charging member is a doctor blade. When the positively chargeable toner composes a two-component developer, the positively chargeable toner is positively charged through friction with the carrier in a development device. The carrier includes a plurality of carrier particles.

The positively chargeable toner according to the present embodiment is usable for image formation for example in an electrophotographic apparatus (image forming apparatus). The following describes an example of image forming methods using the electrophotographic apparatus.

First, an electrostatic latent image is formed on a photosensitive layer of a photosensitive drum on the basis of image data. Next, the formed electrostatic latent image is developed with a positively chargeable toner (development process). In the development process, a development device supplies the positively chargeable toner on a development sleeve to the photosensitive layer of the photosensitive drum so that the positively chargeable toner is attached to the electrostatic latent image by electric force. Thus, the electrostatic latent image is developed to form a toner image on the photosensitive layer of the photosensitive drum. Subsequently, the toner image is transferred to a recording medium (for example, paper), and then the unfixed toner image is fixed to the recording medium through heating. As a result, an image is formed on the recording medium.

[Basic Features of Positively Chargeable Toner]

The positively chargeable toner according to the present embodiment has the following features (hereinafter may be referred to as "basic features"). Specifically, the positively chargeable toner according to the present embodiment includes a plurality of toner particles. Each of the toner particles includes a toner mother particle and an external additive. The toner mother particle includes a toner core and a shell layer. The toner core contains a binder resin. The shell layer covers a surface of the toner core. The external additive includes a plurality of silica particles. Each of the silica particles is present on a surface of the shell layer. The toner core and each of the silica particles are bonded to each other through a covalent bond within the shell layer.

As described above, the toner core and each of the silica particles are bonded to each other through the covalent bond within the shell layer. In this configuration, detachment of the silica particles from the surface of the shell layer can be prevented even when the positively chargeable toner receives stress.

Prevention of the detachment of the silica particles can result in prevention of reduction in fluidity of the toner particles. As a result, a positively chargeable toner excellent in heat-resistant preservation stability can be provided. For example, even when the positively chargeable toner according to the present embodiment is preserved in a high temperature environment for a long period of time, agglomeration of the toner particles can be prevented.

Prevention of the detachment of the silica particles can result in prevention of contamination of a surface of a constitutional member of an image forming apparatus with the silica particles or the toner mother particles. For example, contamination of a surface of the development sleeve can be prevented. Also, contamination of the photosensitive layer of the photosensitive drum can be prevented. In a case where the positively chargeable toner according to the present embodiment composes a two-component developer, prevention of the detachment of the silica particles can result in prevention of contamination of surfaces of carrier particles with the silica particles or the toner mother particles. As a result, a positively chargeable toner excellent in adhesion resistance can be provided. Note that prevention of the contamination of the surface of the development sleeve can result in prevention of occurrence of non-uniform development. Also, prevention of the contamination of the photosensitive layer of the photosensitive drum can result in prevention of occurrence of non-uniform transfer.

Prevention of the contamination of the surfaces of the carrier particles can result in prevention of reduction in charging ability of the carrier. Also, prevention of the contamination of the surfaces of the carrier particles can result in prevention of a situation in which the silica particles receive stress on the surfaces of the carrier particles. Accordingly, it is possible to prevent a situation in which a charge characteristic of the silica particles degrades on the surfaces of the carrier particles. This can also result in prevention of reduction in charging ability of the carrier. Prevention of the reduction in charging ability of the carrier can result in prevention of reduction in charge stability of the positively chargeable toner. As a result, a positively chargeable toner excellent in charge stability can be provided. Therefore, even when the positively chargeable toner according to the present embodiment is used for continuous image formation over a long period of time, occurrence of fogging and large variation in image density can be prevented in formed images.

Each of the silica particles includes a silica base having a surface treated with a surface treatment agent. Preferably, the silica base has the shape of a particle. No surface treatment may be performed on the silica base or a surface treatment may be performed on the silica base with a surface treatment agent other than the surface treatment agent in the present embodiment. The "surface treatment agent other than the surface treatment agent in the present embodiment" refers to any known surface treatment agent except the following first through third treatment agents.

The surface treatment agent in the present embodiment includes the first treatment agent. The first treatment agent has a carboxyl group in a molecule thereof. In a situation in which the surface of the silica base is treated with the first treatment agent, the toner core and each of the silica particles are easily bonded to each other through the covalent bond within the shell layer. The following describes the covalent bond (hereinafter referred to as a "specific covalent bond") within the shell layer through which the toner core and each of the silica particles are bonded to each other by explaining a chemical structure of a vinyl resin contained in the shell layer. Note that whether or not the specific covalent bond exists can be confirmed by a method described later in Examples or a method in accordance therewith.

The specific covalent bond includes a first amide bond and a second amide bond. The shell layer contains the vinyl resin. A vinyl resin is typically a homopolymer or a copolymer of a vinyl compound. The vinyl compound has at least one functional group among a vinyl group ($CH_2$═CH—), a vinylidene group ($CH_2$═C<), and a vinylene group (—CH═CH—) in a molecule thereof. The vinyl compound forms a macromolecule (vinyl resin) as a result of addition polymerization through cleavage of a carbon-to-carbon double bond (C═C) included in the functional group such as the vinyl group.

In the present embodiment, the vinyl resin includes a constitutional unit represented by formula (1-1) shown below (hereinafter referred to as a "constitutional unit (1-1)"), a constitutional unit represented by formula (1-2) shown below (hereinafter referred to as a "constitutional unit (1-2)"), and a constitutional unit represented by formula (1-3) shown below (hereinafter referred to as a "constitutional unit (1-3)"). An amide bond [C(═O)—NH] included in the constitutional unit (1-1) is the first amide bond. An amide bond [C(═O)—NH] included in the constitutional unit (1-2) is the second amide bond. In the following description, the vinyl resin including the constitutional units (1-1), (1-2), and (1-3) will be referred to as a "specific vinyl resin".

(1-1)

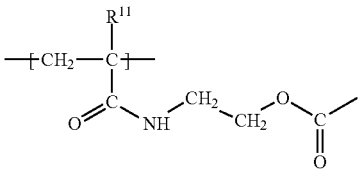

In formula (1-1), $R^{11}$ represents a hydrogen atom or an alkyl group optionally substituted with a substituent. The alkyl group includes a straight-chain alkyl group, a branched-chain alkyl group, and a cyclic alkyl group. An example of the substituent is a phenyl group. Preferably, $R^{11}$ represents a hydrogen atom, a methyl group, an ethyl group, or an isopropyl group. In formula (1-1), an available bond of a carbon atom bonded to two oxygen atoms is connected to an atom of a binder resin.

(1-2)

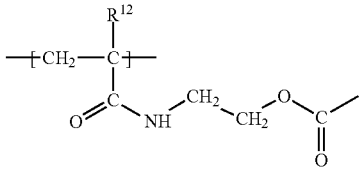

In formula (1-2), $R^{12}$ represents a hydrogen atom or an alkyl group optionally substituted with a substituent. The alkyl group includes a straight-chain alkyl group, a branched-chain alkyl group, and a cyclic alkyl group. An example of the substituent is a phenyl group. Preferably, $R^{12}$ represents a hydrogen atom, a methyl group, an ethyl group, or an isopropyl group. In formula (1-2), an available bond of a carbon atom bonded to two oxygen atoms is connected to an atom of the first treatment agent.

(1-3)

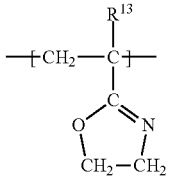

In formula (1-3), $R^{13}$ represents a hydrogen atom or an alkyl group optionally substituted with a substituent. The alkyl group includes a straight-chain alkyl group, a branched-chain alkyl group, and a cyclic alkyl group. An example of the substituent is a phenyl group. Preferably, $R^{13}$ represents a hydrogen atom, a methyl group, an ethyl group, or an isopropyl group.

The specific vinyl resin includes the constitutional unit (1-3). The constitutional unit (1-3) includes a ring-unopened oxazoline group. The ring-unopened oxazoline group has a cyclic structure and exhibits strong positive chargeability. Also, the ring-unopened oxazoline group is ring-opened through reaction with a carboxyl group to form an amide bond. Accordingly, it is possible to increase heat-resistant preservability, a charge decay characteristic, and a charge rise characteristic of the positively chargeable toner by controlling a ring-opening rate of oxazoline groups included in the specific vinyl resin. Specifically, heat-resistant preservability of the positively chargeable toner can be increased by causing ring-opening of the oxazoline groups to an appropriate extent in the specific vinyl resin. The charge decay characteristic of the positively chargeable toner can be increased by controlling the ring-opening rate such that an amount of ring-unopened oxazoline groups left in the specific vinyl resin is not too much. The charge rise characteristic of the positively chargeable toner can be increased by controlling the ring-opening rate such that an appropriate amount of ring-unopened oxazoline groups is left in the specific vinyl resin. More specifically, an amount of ring-unopened oxazoline groups included in 1 g of the positively chargeable toner as measured by gas chromatography-mass spectrometry is at least 0.10 μmol and no greater than 100 μmol in the present embodiment. Note that the amount of the ring-unopened oxazoline groups included in 1 g of the positively chargeable toner can be determined by a method described later in Examples or a method in accordance therewith.

Preferably, the surface treatment agent further includes the second treatment agent. The second treatment agent is a hydrophobizing agent. In a situation in which the surface of the silica base is treated with a hydrophobizing agent, the surface of the silica base becomes hydrophobic. Accordingly, surfaces of the toner particles can be easily made hydrophobic. Therefore, in a situation in which the surface treatment agent further includes the second treatment agent, hydrophobicity of the surfaces of the toner particles can be maintained over a long period of time when detachment of the silica particles is prevented. As a result, reduction in charge stability of the toner can be prevented even in a high temperature and high humidity environment. More preferably, a hydrophobicity of the silica particles is at least 60%. In a situation in which the hydrophobicity of the silica particles is at least 60%, hydrophobicity of the surfaces of the toner particles tends to be maintained over a long period of time. The hydrophobicity of the silica particles can be determined by a method described later in Examples or a method in accordance therewith.

Preferably, the surface treatment agent further includes the third treatment agent. The third treatment agent has a nitrogen atom in a molecule thereof. In a situation in which the surface of the silica base is treated with the third treatment agent, the surface of the silica base is rendered positively chargeable. Accordingly, the surfaces of the toner particles can be easily rendered positively chargeable. Therefore, in a situation in which the surface treatment agent further includes the third treatment agent, charge stability of the positively chargeable toner can be further increased when detachment of the silica particles is prevented.

[Preferable Method for Producing Positively Chargeable Toner]

A preferable method for producing the positively chargeable toner according to the present embodiment includes: preparation of toner cores; preparation of silica particles; preparation for a shell layer formation liquid; production of toner mother particles; and addition of an external additive. Note that toner particles produced at the same time are thought to have substantially the same structure as one another.

<Preparation of Toner Cores>

In the preparation of toner cores, toner cores each having a first carboxyl group at a surface thereof are produced. The toner cores can be easily produced by a known pulverization method or a known aggregation method.

In a case where either of the above methods is adopted, a binder resin to be used preferably includes at least one resin having an acid value of at least 5 mgKOH/g and no greater than 50 mgKOH/g. Through use of such a binder resin, the toner cores each having the first carboxyl group at the surface thereof can be easily obtained.

<Preparation of Silica Particles>

In the preparation of silica particles, silica particles each having a second carboxyl group at a surface thereof are produced.

Preferably, the surface of the silica base is treated with a surface treatment agent. More specifically, first, the surface treatment agent is attached to the surface of the silica base. The silica base may be immersed in the surface treatment agent. Alternatively, the surface treatment agent may be sprayed onto the silica base in a fluidized bed. In a case of spraying the surface treatment agent onto the silica base in the fluidized bed, a fluidized bed granulation and coating machine (for example, "SPIRA COTA" manufactured by OKADA SEIKO CO., LTD.) is preferably used. Next, a thermal treatment is performed at a specific temperature on the silica base including the surface treatment agent attached to the surface thereof. Thus, the silica particles each having the second carboxyl group at the surface thereof are produced.

The surface treatment agent includes the first treatment agent, preferably includes the first treatment agent and the second treatment agent, and more preferably includes the first treatment agent, the second treatment agent, and the third treatment agent. The first treatment agent is preferably a reactive silicone oil (hereinafter referred to as a "carboxyl-modified silicone oil") having a carboxyl group in a molecule thereof. Examples of the carboxyl-modified silicone oil include a carboxyl-modified silicone oil (2-1), a carboxyl-modified silicone oil (3-1), and a carboxyl-modified silicone oil (4-1). The first treatment agent may be any of the carboxyl-modified silicone oil (2-1), the carboxyl-modified silicone oil (3-1), and the carboxyl-modified silicone oil (4-1). The first treatment agent may include at least two of the carboxyl-modified silicone oil (2-1), the carboxyl-modified silicone oil (3-1), and the carboxyl-modified silicone oil (4-1).

The carboxyl-modified silicone oil (2-1) is represented by formula (2-1) shown below. In formula (2-1) shown below, $R^{21}$ to $R^{29}$ each represent, independently of one another, an alkyl group optionally substituted with a substituent. Preferably, $R^{21}$ to $R^{29}$ each represent, independently of one another, an alkyl group, and more preferably represent an alkyl group having a carbon number of at least 1 and no greater than 5. Also, $n_{21}$ and $n_{22}$ each represent, independently of each other, an integer of at least 1. Preferably, $n_{21}$ and $n_{22}$ each represent, independently of each other, an integer of at least 1 and no greater than 100, and more preferably represent an integer of at least 10 and no greater than 100. $X^1$ represents —R—COOH. R represents an alkylene group optionally substituted with a substituent.

In a case where a commercially available carboxyl-modified silicone oil (2-1) is used, "X-22-3701E" manufactured by Shin-Etsu Chemical Co., Ltd. can be used, for example. In the carboxyl-modified silicone oil (2-1) contained in "X-22-3701E" manufactured by Shin-Etsu Chemical Co., Ltd., $R^{21}$ to $R^{29}$ each represent a methyl group.

(2-1)

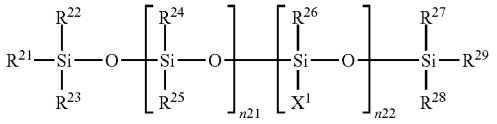

The carboxyl-modified silicone oil (3-1) is represented by formula (3-1) shown below. In formula (3-1) shown below, $R^{31}$ to $R^{37}$ each represent, independently of one another, an alkyl group optionally substituted with a substituent. Preferably, $R^{31}$ to $R^{37}$ each represent, independently of one another, an alkyl group, and more preferably an alkyl group having a carbon number of at least 1 and no greater than 5. Also, $n_{31}$ represents an integer of at least 1. Preferably, $n_{31}$ represents an integer of at least 1 and no greater than 100, and more preferably represent an integer of at least 10 and no greater than 100. $X^1$ is as described above.

In a case where a commercially available carboxyl-modified silicone oil (3-1) is used, "X-22-3710" manufactured by Shin-Etsu Chemical Co., Ltd. can be used, for example. In the carboxyl-modified silicone oil (3-1) contained in "X-22-3710" manufactured by Shin-Etsu Chemical Co., Ltd., $R^{31}$ to $R^{37}$ each represent a methyl group.

(3-1)

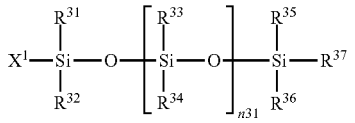

The carboxyl-modified silicone oil (4-1) is represented by a chemical formula similar to that of the carboxyl-modified silicone oil (3-1). Specifically, the carboxyl-modified silicone oil (4-1) is represented by formula (4-1) shown below. In formula (4-1), $R^{31}$ to $R^{36}$, $n_{31}$, and $X^1$ are the same as $R^{31}$ to $R^{36}$, $n_{31}$, and $X^1$ in formula (3-1), respectively. Two $X^1$ in formula (4-1) may be the same as or different from each other.

(4-1)

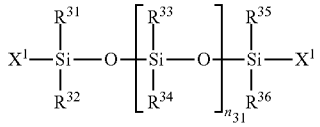

In a case where a commercially available carboxyl-modified silicone oil (4-1) is used, "X-22-162C" manufactured by Shin-Etsu Chemical Co., Ltd. can be used, for example. In the carboxyl-modified silicone oil (4-1) contained in "X-22-162C" manufactured by Shin-Etsu Chemical Co., Ltd., $R^{31}$ to $R^{36}$ each represent a methyl group.

The second treatment agent is preferably an alkoxysilane having an alkyl group (hereinafter referred to as an "alkylalkoxysilane"). The alkylalkoxysilane is represented by formula (5-1) shown below. In formula (5-1) shown below, $R^{51}$ represents an alkyl group optionally substituted with a substituent. The alkyl group includes a straight-chain alkyl group, a branched-chain alkyl group, and a cyclic alkyl group. The carbon number of $R^{51}$ is preferably at least 1 and no greater than 5. $R^{52}$, $R^{53}$, and $R^{54}$ each represent, independently of one another, a hydrogen atom or an alkyl group optionally substituted with a substituent, preferably represent an alkyl group, and more preferably represent an alkyl group having a carbon number of at least 1 and no greater than 5.

In a case where a commercially available alkylalkoxysilane is used, "KBM-3033" manufactured by Shin-Etsu Chemical Co., Ltd. can be used, for example. In the alkylalkoxysilane contained in "KBM-3033" manufactured by Shin-Etsu Chemical Co., Ltd., $R^{51}$ represents an n-propyl group and each of $R^{52}$, $R^{53}$, and $R^{54}$ represents a methyl group.

(5-1)

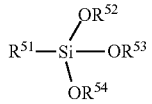

The third treatment agent is preferably an alkoxysilane having an amino group (hereinafter referred to as an "aminoalkoxysilane"). The aminoalkoxysilane is represented by formula (6-1) shown below. In formula (6-1) shown below, $R^{61}$ and $R^{62}$ each represent, independently of each other, a hydrogen atom or an alkyl group optionally substituted with a substituent, and preferably a hydrogen atom. $R^{63}$ represents an alkylene group optionally substituted with a substituent, preferably represents an alkylene group, and more preferably represents an alkylene group having a carbon number of at least 1 and no greater than 5. $R^{64}$, $R^{65}$, and $R^{66}$ each represent, independently of one another, an alkyl group optionally substituted with a substituent, preferably an alkyl group, and more preferably an alkyl group having a carbon number of at least 1 and no greater than 5.

In a case where a commercially available aminoalkoxysilane is used, "KBE-903" manufactured by Shin-Etsu Chemical Co., Ltd. can be used, for example. In the aminoalkoxysilane contained in "KBE-903" manufactured by Shin-Etsu Chemical Co., Ltd., $R^{61}$ and $R^{62}$ each represent a hydrogen atom, $R^{63}$ represents a propylene group, and each of $R^{64}$, $R^{65}$, and $R^{66}$ represents an ethyl group.

(6-1)

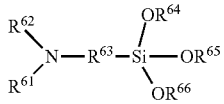

When a thermal treatment is performed at a specific temperature on the silica base including the surface treatment agent as above attached to the surface thereof, a functional group represented by formula (5-2) shown below (hereinafter referred to as a "functional group (5-2)") and a functional group represented by formula (6-2) shown below (hereinafter referred to as a "functional group (6-2)") are bonded to the surface of the silica base. Therefore, a carboxyl-modified silicone oil tends to exist in the vicinity of the surface of the silica base. As a result, the silica particles each having the second carboxyl group at the surface thereof can be easily obtained.

Specifically, alkoxy groups (more specifically, $OR^{52}$ group, $OR^{53}$ group, and $OR^{54}$ group) included in the alkylalkoxysilane are hydrolyzed by the thermal treatment to form hydroxyl groups. While some of the hydroxyl groups generated through hydrolysis are bonded to each other to form a silanol bond, some of the rest of the hydroxyl groups react with hydroxyl groups present on the surface of the silica base (dehydration reaction). Therefore, the functional group (5-2) is bonded to the surface of the silica base. In formula (5-2) shown below, $R^{51}$ is as described above. Further, x represents an integer of at least 1. Preferably, x represents an integer of at least 1 and no greater than 100, and more preferably represents an integer of at least 10 and no greater than 100.

(5-2)

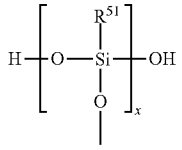

Also, alkoxy groups (more specifically, $OR^{64}$ group, $OR^{65}$ group, and $OR^{66}$ group) included in the aminoalkoxysilane are hydrolyzed by the thermal treatment to form hydroxyl groups. While some of the hydroxyl groups generated through hydrolysis are bonded to each other to form a silanol bond, some of the rest of the hydroxyl groups react with hydroxyl groups present on the surface of the silica base (dehydration reaction). Therefore, the functional group (6-2) is bonded to the surface of the silica base. In formula (6-2) shown below, $R^{61}$ to $R^{63}$ are as described above. Further, y represents an integer of at least 1. Preferably, y represents an integer of at least 1 and no greater than 100, and more preferably represents an integer of at least 10 and no greater than 100.

(6-2)

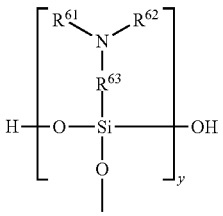

As described above, the functional group (5-2) and the functional group (6-2) each include a silanol bond. Also, as shown above in formulas (2-1), (3-1), and (4-1), each of the carboxyl-modified silicone oils includes a silanol bond in a molecule thereof. Accordingly, intermolecular interaction tends to act between the functional group (5-2) and the carboxyl-modified silicone oil and between the functional group (6-2) and the carboxyl-modified silicone oil. Therefore, the carboxyl-modified silicone oil tends to exist in the vicinity of the surface of the silica base. Furthermore, the functional group (5-2) and the functional group (6-2) serve as steric hindrances to prevent the carboxyl-modified silicone oil from departing from the surface of the silica base. For also the reasons as above, the carboxyl-modified silicone oil tends to exist in the vicinity of the surface of the silica base.

Preferably, the thermal treatment on the silica base including the surface treatment agent attached to the surface thereof is performed at a temperature (thermal treatment temperature) equal to or higher than a temperature at which the above-described dehydration reaction (specifically, reaction between the hydroxyl groups generated through hydrolysis of the alkoxy groups and the hydroxyl groups present on the surface of the silica base) takes place. For example, the thermal treatment temperature is preferably at least 150° C. and no higher than 500° C. Preferably, the thermal treatment on the silica base including the surface treatment agent attached to the surface thereof is performed for a time (thermal treatment time) equal to or longer than a time necessary for completion of the above-described dehydration reaction. For example, the thermal treatment time is preferably at least 30 minutes and no longer than 5 hours. Typically, silica is excellent in heat resistance. Therefore, the chemical structure of silica is thought to hardly change even when the thermal treatment is performed at a high temperature.

In the resultant silica particles, the functional group (5-2) is bonded to the surface of the silica base. Therefore, the silica particles tend to be strongly hydrophobic. For example, the silica particles tend to have a hydrophobicity of at least 60%. The higher the hydrophobicity of the silica particles is, the more hydrophobic toner particles to be obtained tend to be. However, the higher the hydrophobicity of the silica particles is, the lower an acid value of the silica particles tends to be. Therefore, the silica particles tend to be difficult to be bonded to the toner core. The hydrophobicity of the resultant silica particles is preferably at least 60% and no greater than 80%, for example.

<Preparation of Shell Layer Formation Liquid>

In the preparation of a shell layer formation liquid, a solution containing a vinyl resin for shell layer formation (vinyl resin for formation) is prepared. The vinyl resin for formation includes the constitutional unit (1-3). As the solution of the vinyl resin for formation, "EPOCROS (registered Japanese trademark) WS-300" or "EPOCROS WS-700" manufactured by Nippon Shokubai Co., Ltd. can be used, for example. EPOCROS WS-300 contains a copolymer (water-soluble cross-linking agent) of 2-vinyl-2-oxazoline and methyl methacrylate. The mass ratio of the monomers composing the copolymer is (2-vinyl-2-oxazoline):(methyl methacrylate)=9:1. EPOCROS WS-700 contains a copolymer (water-soluble cross-linking agent) of 2-vinyl-2-oxazoline, methyl methacrylate, and butyl acrylate. The mass ratio of the monomers composing the copolymer is (2-vinyl-2-oxazoline):(methyl methacrylate):(butyl acrylate)=5:4:1. The 2-vinyl-2-oxazoline is equivalent to a vinyl compound represented by formula (1-4) shown below (hereinafter referred to as a "vinyl compound (1-4)") in which $R^{14}$ represents a hydrogen atom.

(1-4)

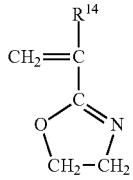

In formula (1-4), $R^{14}$ represents a hydrogen atom or an alkyl group optionally substituted with a substituent. The alkyl group includes a straight-chain alkyl group, a branched-chain alkyl group, and a cyclic alkyl group. An example of the substituent is a phenyl group. Preferably, $R^{14}$ represents a hydrogen atom, a methyl group, an ethyl group, or an isopropyl group.

<Production of Toner Mother Particles>

In the production of toner mother particles, the toner cores and the shell layer formation liquid are mixed at a first temperature. The first temperature is equal to or higher than a temperature at which an oxazoline group and the first carboxyl group react with each other to form an amide bond (more specifically, the first amide bond). Through the above, shell layers are formed. As a result, a dispersion of toner mother particles is obtained. A plurality of the toner mother particles are obtained through solid-liquid separation, washing, and drying on the obtained dispersion.

Specifically, the toner cores and the shell layer formation liquid are first mixed to obtain a dispersion. Through mixing as above, a material for forming the shell layers (shell material) is attached to surfaces of the toner cores in the dispersion. In order to attach the shell material uniformly on the surfaces of the toner cores, it is preferable to achieve a high degree of dispersion of the toner cores in the dispersion. In order to achieve a high degree of dispersion of the toner cores in the dispersion, a surfactant may be added to the dispersion or the dispersion may be stirred using a powerful stirrer (for example, "HIVIS DISPER MIX" manufactured by PRIMIX Corporation).

Next, a temperature of the dispersion is increased up to the first temperature at a specific heating rate while the dispersion is stirred. Thereafter, the temperature of the dispersion is kept at the first temperature for a specific time while the dispersion is stirred. As described above, the first temperature is equal to or higher than a temperature at which an oxazoline group and the first carboxyl group react with each other to form the first amide bond. Therefore, it is thought that the reaction proceeds between some of a plurality of oxazoline groups included in the vinyl resin for formation and the first carboxyl groups while the temperature of the dispersion is kept at the first temperature.

Preferably, the first temperature is selected from a range from 50° C. to 100° C. In a situation in which the first temperature is excessively low, the reaction between the oxazoline groups and the first carboxyl groups may hardly proceed. Also, in a situation in which the first temperature is excessively low, the shell material may be hardly hardened on the surfaces of the toner cores. In a situation in which the first temperature is excessively high, dispersibility of the toner cores in the dispersion may decrease. When dispersibility of the toner cores in the dispersion decreases, the toner cores tend to agglomerate in the dispersion. Therefore, it becomes difficult to attach the shell material uniformly on the surfaces of the toner cores.

Preferably, the dispersion (dispersion containing the toner cores and the shell layer formation liquid) further contains at least one of a basic substance and a ring-opening agent. The amount of the ring-unopened oxazoline groups can be changed by changing respective amounts of the basic substance and the ring-opening agent. More specifically, the larger the amount of the basic substance in the dispersion is, the larger the amount of the ring-unopened oxazoline groups tends to be. It is thought that in a situation in which the dispersion further contains the basic substance, the first carboxyl group tends to be neutralized by the basic substance and a ring-opening reaction of the oxazoline groups accordingly tends to be inhibited. The larger the amount of the ring-opening agent in the dispersion is, the smaller the amount of the ring-unopened oxazoline groups tends to be. This is because the ring-opening agent promotes the ring-opening reaction of the oxazoline groups. Preferably, the basic substance is ammonia or sodium hydroxide, for example. Preferably, the ring-opening agent is acetic acid, for example.

Preferably, the specific heating rate is selected from a range of from 0.1° C./minute to 3.0° C./minute, for example. Preferably, the specific time is selected from a range of from 30 minutes to 4 hours, for example. Preferably, the dispersion is stirred at a rotational speed of at least 50 rpm and no greater than 500 rpm. When the dispersion is stirred as above, the reaction between the oxazoline groups and the first carboxyl groups readily proceeds.

<Addition of External Additive>

In the addition of an external additive, the toner mother particles and the silica particles are mixed at a second temperature. The second temperature is equal to or higher than a temperature at which an oxazoline group and the second carboxyl group react with each other to form an amide bond (more specifically, the second amide bond). Accordingly, when the toner mother particles and the silica particles are mixed at the second temperature, among the plurality of oxazoline groups included in the vinyl resin for formation, some oxazoline groups that do not react with the first carboxyl groups react with the second carboxyl groups. Thus, a toner including a plurality of toner particles is obtained.

The second temperature is preferably at least 20° C., and more preferably selected from a range of from 20° C. and no higher than 50° C. In a situation in which the second temperature is excessively low, the reaction between the oxazoline groups and the second carboxyl groups may hardly proceed. In a situation in which the second temperature is excessively high, a low-melting material (for example, a binder resin or a releasing agent) contained in the toner mother particles may melt. It is known that a reaction between an oxazoline group and a carboxyl group typically proceeds moderately even at room temperature. Accordingly, it is thought that even if the first temperature is at least 20° C. and lower than 50° C., the oxazoline group and the first carboxyl group react with each other to form the first amide bond. However, in a situation in which the first temperature is at least 20° C. and lower than 50° C., the shell material may be hardly hardened on the surfaces of the toner cores. Therefore, the first temperature is preferably selected from a range of from 50° C. to 100° C. By contrast, monomers are not hardened in the addition of an external additive. Therefore, the second temperature can be selected from a range of from 20° C. to 50° C.

In the addition of an external additive, the toner mother particles, the silica particles, and additional external additive particles (external additive particles other than the silica particles) may be mixed at the second temperature.

[Examples of Materials Composing Positively Chargeable Toner]

<Toner Cores>

The toner cores contain a binder resin. The toner cores may further contain at least one of a colorant, a charge control agent, and a releasing agent.

(Binder Resin)

The binder resin is typically a main component (for example, at least 85% by mass) of the toner cores. Therefore, properties of the binder resin are thought to have a great influence on overall properties of the toner cores.

Properties of the binder resin (specific examples include hydroxyl value, acid value, glass transition point, and softening point) can be adjusted through use of different resins in combination as the binder resin. For example, in a situation in which the binder resin has an ester group, a hydroxyl group, an ether group, an acid group, or a methyl group, the toner cores have a strong tendency to be anionic.

The binder resin preferably includes at least one resin having an acid value of at least 5 mgKOH/g and no greater than 50 mgKOH/g. In this configuration, the binder resin tends to have an acid value of at least 5 mgKOH/g and no greater than 50 mgKOH/g. In a situation in which the acid value of the binder resin is excessively small, the reaction between the oxazoline groups and the first carboxyl groups hardly proceeds. Therefore, the first amide bond may be hardly formed. In a situation in which the acid value of the binder resin is excessively large, an amount of charge of the toner may decrease when the toner is used for image formation in a high temperature and high humidity environment. An acid value of a resin is measured by a method described later in Examples or a method in accordance therewith.

Examples of resins having an acid value of at least 5 mgKOH/g and no greater than 50 mgKOH/g include polyester resins and styrene-acrylic acid-based resins. The following describes a polyester resin and a styrene-acrylic acid-based resin in order.

(Binder Resin: Polyester Resin)

A polyester resin is a copolymer of at least one alcohol and at least one carboxylic acid. Examples of alcohols that can be used for synthesis of the polyester resin include dihydric alcohols and tri- or higher-hydric alcohols listed below. Examples of dihydric alcohols that can be used include diols and bisphenols. Examples of carboxylic acids that can be used for synthesis of the polyester resin include dibasic carboxylic acids and tri- or higher-basic carboxylic acids listed below.

Examples of preferable diols include aliphatic diols. Examples of preferable aliphatic diols include diethylene glycol, triethylene glycol, neopentyl glycol, 1,2-propanediol, α,ω-alkanediols, 2-butene-1,4-diol, 1,4-cyclohexanedimethanol, dipropylene glycol, polyethylene glycol, polypropylene glycol, and polytetramethylene glycol. Examples of preferable α,ω-alkanediols include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids, α,ω-alkanedicarboxylic acids, unsaturated dicarboxylic acids, and cycloalkane dicarboxylic acids. Examples of preferable aromatic dicarboxylic acids include phthalic acid, terephthalic acid, and isophthalic acid. Examples of preferable α,ω-alkanedicarboxylic acids include malonic acid, succinic acid, adipic acid, suberic acid, azelaic acid, sebacic acid, and 1,10-decanedicarboxylic acid. Examples of preferable unsaturated dicarboxylic acids include maleic acid, fumaric acid, citraconic acid, itaconic acid, and glutaconic acid. Examples of preferable cycloalkane dicarboxylic acids include cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Binder Resin: Styrene-Acrylic Acid-Based Resin)

A styrene-acrylic acid-based resin is a copolymer of at least one styrene-based monomer and at least one acrylic acid-based monomer. Examples of styrene-based monomers that can be preferably used for synthesis of the styrene-acrylic acid-based resin include styrene-based monomers listed below. Examples of acrylic acid-based monomers that can be preferably used for synthesis of the styrene-acrylic acid-based resin include acrylic acid-based monomers listed below.

Examples of preferable styrene-based monomers include styrene, alkyl styrenes, hydroxystyrenes, and halogenated styrenes. Examples of preferable alkyl styrenes include α-methylstyrene, m-methylstyrene, p-methylstyrene, p-ethylstyrene, and 4-tert-butylstyrene. Examples of preferable hydroxystyrenes include p-hydroxystyrene and m-hydroxystyrene. Examples of preferable halogenated styrenes include α-chlorostyrene, o-chlorostyrene, m-chlorostyrene, and p-chlorostyrene.

Examples of preferable acrylic acid-based monomers include (meth)acrylic acid, (meth)acrylonitrile, (meth) acrylic acid alkyl esters, and (meth)acrylic acid hydroxyalkyl esters. Examples of preferable (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Examples of preferable (meth)acrylic acid hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate.

(Binder Resin: Additional Resin)

The binder resin may further include a resin (additional resin) other than the polyester resin and the styrene-acrylic acid-based resin. Preferably, the additional resin is a thermoplastic resin (additional thermoplastic resin) other than the polyester resin and the styrene-acrylic acid-based resin. Examples of preferable additional thermoplastic resins include styrene-based resins, acrylic acid-based resins, olefin-based resins, vinyl resins, polyamide resins, and urethane resins. Examples of preferable styrene-based resins include homopolymers and copolymers of the styrene-based monomers listed above in (Binder Resin: Styrene-Acrylic Acid-based Resin). Examples of preferable acrylic acid-based resins include homopolymers and copolymers of the acrylic acid-based monomers listed above in (Binder Resin: Styrene-Acrylic Acid-based Resin). Examples of preferable olefin-based resins include polyethylene resins and polypropylene resins. Examples of preferable vinyl resins include vinyl chloride resins, polyvinyl alcohols, vinyl ether resins, and N-vinyl resins. Copolymers of the above-listed resins (that is, copolymers obtained through incorporation of any constitutional unit into the above-listed resins) may also be used as the additional thermoplastic resin. For example, a styrene-butadiene-based resin may be used as the additional thermoplastic resin.

(Colorant)

A known pigment or dye that matches the color of the positively chargeable toner can be used as a colorant. In order to form high-quality images using the positively chargeable toner, the amount of the colorant is preferably at least 1 part by mass and no greater than 20 parts by mass relative to 100 parts by mass of the binder resin.

The toner mother particles may contain a black colorant. Carbon black can for example be used as a black colorant. Alternatively, a colorant adjusted to a black color using a yellow colorant, a magenta colorant, and a cyan colorant may be used as a black colorant.

The toner mother particles may contain a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Specific examples of yellow colorants that can be used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Specific examples of cyan colorants that can be used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

A releasing agent is used for example in order to improve fixability or hot offset resistance of the positively chargeable toner. In order to increase cationic strength of the toner mother particles, it is preferable to produce the toner mother particles using a cationic wax.

Examples of preferable releasing agents include aliphatic hydrocarbon waxes, plant waxes, animal waxes, mineral waxes, waxes having a fatty acid ester as a main component, and waxes in which a fatty acid ester is partially or entirely deoxidized. Examples of preferable aliphatic hydrocarbon waxes include low molecular weight polyethylene, low molecular weight polypropylene, polyolefin copolymer, polyolefin wax, microcrystalline wax, paraffin wax, and Fischer-Tropsch wax. Oxides of the above compounds are also included in aliphatic hydrocarbon waxes. Examples of preferable plant waxes include candelilla wax, carnauba wax, Japan wax, jojoba wax, and rice wax. Examples of preferable animal waxes include beeswax, lanolin, and spermaceti. Examples of preferable mineral waxes include ozokerite, ceresin, and petrolatum. Examples of preferable waxes having a fatty acid ester as a main component include montanic acid ester wax and castor wax. A wax may be used independently, or a plurality of waxes may be used in combination.

(Charge Control Agent)

A charge control agent is used for example in order to improve charge stability or a charge rise characteristic of the positively chargeable toner. The charge rise characteristic of the positively chargeable toner is an indicator as to whether or not the positively chargeable toner can be charged to a specific charge level in a short period of time. Cationic strength of the toner mother particles can be increased through inclusion of a positively chargeable charge control agent in the toner mother particles.

<Shell Layer>

The shell layer contains the specific vinyl resin. The specific vinyl resin includes the constitutional unit (1-1), the constitutional unit (1-2), and the constitutional unit (1-3). All of the constitutional units (1-1), (1-2), and (1-3) are derived from the vinyl compound (1-4). The specific vinyl resin may further include a constitutional unit derived from a vinyl compound (additional vinyl compound) other than the vinyl compound (1-4). Preferably, the additional vinyl compound is at least one vinyl compound selected from the group consisting of styrene-based monomers and acrylic acid-based monomers. For example, in a case where the additional vinyl compound is a (meth)acrylic acid alkyl ester, the specific vinyl resin further includes a constitutional unit represented by formula (1-5) shown below.

(1-5)

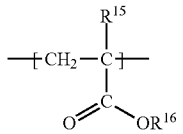

In formula (1-5), $R^{15}$ represents a hydrogen atom or a methyl group. In a case where the additional vinyl compound is an acrylic acid alkyl ester, $R^{15}$ represents a hydrogen atom. In a case where the additional vinyl compound is a methacrylic acid alkyl ester, $R^{15}$ represents a methyl group. $R^{16}$ represents an alkyl group optionally substituted with a substituent. The alkyl group includes a straight-chain alkyl group, a branched-chain alkyl group, and a cyclic alkyl group. Preferably, the alkyl group is an alkyl group having a carbon number of at least 1 and no greater than 8. More preferably, $R^{16}$ represents a methyl group, an ethyl group, an n-propyl group, an isopropyl group, an n-butyl group, an isobutyl group, a 2-ethylhexyl group, a hydroxyethyl group, a hydroxypropyl group, or a hydroxybutyl group.

In a situation in which the shell layer has an excessively small thickness, heat-resistant preservation stability of the positively chargeable toner may decrease. In a situation in which the shell layer has an excessively large thickness, low-temperature fixability of the positively chargeable toner may decrease. The thickness of the shell layer is preferably at least 10 nm and no greater than 50 nm, for example.

<External Additive>

(Silica Particles)

In a situation in which the acid value of the silica particles is excessively small, the reaction between the oxazoline groups and the second carboxyl groups hardly proceeds, and therefore, the second amide bond may be hardly formed. In a situation in which the acid value of the silica particles is excessively large, an amount of charge of the toner may decrease when the toner is used for image formation in a high temperature and high humidity environment.

The amount of the silica particles is preferably at least 0.5 parts by mass and no greater than 10.0 parts by mass relative to 100 parts by mass of the toner mother particles. Preferably, the silica base has the shape of a particle with a number average primary particle diameter of at least 10 nm and no greater than 50 nm. In a situation in which the number average primary particle diameter of the silica base is excessively small, it may be difficult to perform a surface treatment on the silica base. Also, it may be difficult to produce the silica base. In a situation in which the number average primary particle diameter of the silica base is excessively large, a surface region of the shell layer may have no space for other external additive particles to be attached.

(Other External Additive Particles)

The external additive may further include other external additive particles. The other external additive particles may be resin particles or particles containing a metal oxide. Examples of preferable metal oxides include alumina, titanium oxide, magnesium oxide, zinc oxide, strontium titanate, and barium titanate. Examples of preferable resins contained in the resin particles include the thermoplastic resins described above in (Binder Resin) and crosslinked resins. Preferably, the crosslinked resins are each a polymer of a cross-linking agent and at least one monomer that can form a thermoplastic resin.

EXAMPLES

The following describes examples of the present disclosure. Table 1 shows compositions of toners according to Examples and Comparative Examples.

TABLE 1

| Toner | Toner mother particle | Silica particle |
|---|---|---|
| TA-1 | PT-1 | PS-1 |
| TA-2 | PT-2 | PS-1 |
| TA-3 | PT-3 | PS-1 |
| TA-4 | PT-2 | PS-2 |
| TA-5 | PT-2 | PS-3 |
| TA-6 | PT-2 | PS-4 |
| TA-7 | PT-4 | PS-1 |
| TA-8 | PT-5 | PS-1 |
| TB-1 | PT-6 | PS-5 |
| TB-2 | PT-7 | PS-1 |
| TB-3 | PT-8 | PS-1 |
| TB-4 | PT-7 | PS-5 |
| TB-5 | PT-9 | PS-1 |
| TB-6 | PT-6 | PS-6 |

Table 2 shows compositions of toner mother particles used in Examples and Comparative Examples. In Table 2, "WS-300" represents "EPOCROS WS-300" manufactured by Nippon Shokubai Co., Ltd. "EPOCROS WS-300" manufactured by Nippon Shokubai Co., Ltd. has a solid concentration of 10% by mass. "WS-700" represents "EPOCROS WS-700" manufactured by Nippon Shokubai Co., Ltd. "EPOCROS WS-700" manufactured by Nippon Shokubai Co., Ltd. has a solid concentration of 25% by mass.

TABLE 2

| Toner mother particle | Shell layer: Aqueous solution of oxazoline group-containing macromolecule: Product No. | Amount (% by mass) | Acetic acid (mL) |
|---|---|---|---|
| PT-1 | WS-300 | 1.0 | 0.2 |
| PT-2 | WS-300 | 5.0 | 0.0 |
| PT-3 | WS-300 | 9.0 | 0.0 |
| PT-4 | WS-300 | 5.0 | 2.0 |
| PT-5 | WS-700 | 2.0 | 0.2 |
| PT-6 | WS-300 | 0.7 | 0.5 |
| PT-7 | WS-300 | 0.5 | 0.5 |
| PT-8 | WS-300 | 12.0 | 0.0 |
| PT-9 | — | 0.0 | 0.0 |

Table 3 shows compositions and physical properties of silica particles used in Examples and Comparative Examples. In Table 3, "X-22-3710" represents "X-22-3710" manufactured by Shin-Etsu Chemical Co., Ltd. "X-22-162C" represents "X-22-162C" manufactured by Shin-Etsu Chemical Co., Ltd. "X-22-3701E" represents "X-22-3701E" manufactured by Shin-Etsu Chemical Co., Ltd. "KBM-3033" represents "KBM-3033" manufactured by Shin-Etsu Chemical Co., Ltd. "KBE-903" represents "KBE-903" manufactured by Shin-Etsu Chemical Co., Ltd.

The following describes a method for synthesizing a binder resin used in Examples and Comparative Examples and then describes a method for measuring a physical property value of the obtained binder resin. Next, methods for producing silica particles (more specifically, silica particles PS-1 to PS-6) used in Examples and Comparative Examples will be described and then a method for measuring physical property values of the obtained silica particles will be described. Subsequently, methods for producing toners (more specifically, toners TA-1 to TA-8 and TB-1 to TB-6) according to Examples and Comparative Examples will be described and then a method for measuring physical property values of the obtained toners, evaluation methods of the toners, and evaluation results of the toners will be described in order. Note that in evaluations in which errors might occur, an evaluation value was calculated by obtaining an appropriate number of measured values and calculating the arithmetic mean of the measured values in order to ensure that any errors were sufficiently small.

[Method for Synthesizing Binder Resin]

A four-necked flask (capacity: 5 L) equipped with a thermometer (more specifically, a thermocouple), a nitrogen inlet tube, a drainage tube, a rectification column, and a stirring impeller was set in an oil bath. The flask was charged with 1,250 g of propanediol, 1,720 g of terephthalic acid, and 3 g of tin (II) dioctanoate (esterification catalyst). An internal temperature of the flask was increased up to 220° C. using the oil bath while nitrogen was introduced into the flask. The internal temperature of the flask was kept at 220° C. for 15 hours while the flask contents were stirred in a nitrogen atmosphere. The flask contents reacted (condensation polymerization) while the internal temperature of the flask was kept at 220° C.

An internal pressure of the flask was lowered to 8.0 kPa while the internal temperature of the flask was kept at 220° C. While the flask contents were stirred in the nitrogen atmosphere and the internal pressure of the flask was kept at 8.0 kPa, the internal temperature of the flask was kept at 220° C. until the softening point (Tm) of the flask contents became a desired temperature. The flask contents further reacted (condensation polymerization) while the internal temperature of the flask was kept at 220° C. Through the above, a polyester resin (Tm: 88° C.) was obtained.

[Method for Measuring Physical Property Value of Binder Resin]

<Measurement of Acid Value of Binder Resin>

An acid value of the obtained binder resin (more specifically, the polyester resin) was measured in accordance with a method described in "JIS K0070-1992". Specifically, 20 g of the polyester resin (measurement sample) was placed in a conical flask. Then, 100 mL of a solvent and a few drops

TABLE 3

| Silica particle | Surface treatment agent: First treatment agent: Product No. | Amount (g) | Second treatment agent: Product No. | Amount (g) | Third treatment agent: Product No. | Amount (g) | Hydrophobicity (%) |
|---|---|---|---|---|---|---|---|
| PS-1 | X-22-3710 | 2 | KBM-3033 | 3 | KBE-903 | 5 | 75 |
| PS-2 | X-22-162C | 2 | KBM-3033 | 3 | KBE-903 | 5 | 71 |
| PS-3 | X-22-3701E | 2 | KBM-3033 | 3 | KBE-903 | 5 | 67 |
| PS-4 | X-22-3710 | 5 | KBM-3033 | 3 | KBE-903 | 5 | 66 |
| PS-5 | — | 0 | KBM-3033 | 5 | KBE-903 | 5 | 82 |
| PS-6 | — | 0 | — | 0 | — | 0 | 0 |

of a phenolphthalein solution (indicator) were added into the conical flask. The solvent was a liquid mixture of acetone and toluene (acetone:toluene=1:1 (volume ratio)). The conical flask was shaken in a water bath to dissolve the measurement sample in the solvent. The liquid in the conical flask was titrated with a 0.1 mol/L potassium hydroxide ethanol solution. The acid value (unit: mgKOH/g) was calculated from a result of the titration based on the following equation. The calculated acid value of the polyester resin was 11 mgKOH/g.

$$\text{Acid value}=(B\times f1\times 5.611)/W1$$

In the above equation, "B" represents an amount (mL) of the 0.1 mol/L potassium hydroxide ethanol solution used in the titration. Also, "f1" represents a factor for the 0.1 mol/L potassium hydroxide ethanol solution. "W1" represents a mass (g) of the measurement sample. Further, "5.611" is the formula weight "56.11×(1/10)" of potassium hydroxide.

The factor (f1) was calculated by the following method. First, 25 mL of 0.1 mol/L hydrochloric acid was placed in a conical flask. Then, a phenolphthalein solution was added into the conical flask. The liquid in the conical flask was titrated with the 0.1 mol/L potassium hydroxide ethanol solution. The factor (f1) was calculated from an amount of the 0.1 mol/L potassium hydroxide ethanol solution necessary for neutralization.

[Method for Producing Silica Particles]

<Production of Silica Particles PS-1>

A four-necked flask (capacity: 2 L) equipped with a thermometer, a stirring impeller, and a cooling device was charged with 50 g of hydrophilic fumed silica particles ("AEROSIL (registered Japanese trademark) 90G" manufactured by Nippon Aerosil Co., Ltd., number average primary particle diameter: approximately 20 nm). Nitrogen was introduced into the flask to replace a gas within the flask with nitrogen. Water was sprayed into the flask while the flask contents were stirred. Thereafter, 2 g of a carboxyl-modified silicone oil ("X-22-3710" manufactured by Shin-Etsu Chemical Co., Ltd.), 3 g of an alkylalkoxysilane ("KBM-3033" manufactured by Shin-Etsu Chemical Co., Ltd.), and 5 g of an aminoalkoxysilane ("KBE-903" manufactured by Shin-Etsu Chemical Co., Ltd.) were sprayed into the flask while stirring was continued. An internal temperature of the flask was increased up to 250° C. and kept at 250° C. for 2 hours. A dehydration reaction took place while the internal temperature of the flask was kept at 250° C. More specifically, some hydroxyl groups among a plurality of hydroxyl groups present on surfaces of the hydrophilic fumed silica particles (silica bases) reacted with a hydrolysate of the alkylalkoxysilane and some of the rest of the hydroxyl groups reacted with a hydrolysate of the aminoalkoxysilane. Thereafter, the cooling device was removed from the flask. Nitrogen and an alcohol were removed from the inside of the flask while the internal temperature of the flask was kept at 250° C. Through the above, a plurality of silica particles PS-1 was obtained.

<Production of Silica Particles PS-2 to PS-6>

"X-22-162C" manufactured by Shin-Etsu Chemical Co., Ltd. was used instead of "X-22-3710" manufactured by Shin-Etsu Chemical Co., Ltd. Silica particles PS-2 were obtained by the same method as the method for producing the silica particles PS-1 in all aspects other than the above.

"X-22-3701E" manufactured by Shin-Etsu Chemical Co., Ltd. was used instead of "X-22-3710" manufactured by Shin-Etsu Chemical Co., Ltd. Silica particles PS-3 were obtained by the same method as the method for producing the silica particles PS-1 in all aspects other than the above.

The amount of "X-22-3710" manufactured by Shin-Etsu Chemical Co., Ltd. was changed to 5 g. Silica particles PS-4 were obtained by the same method as the method for producing the silica particles PS-1 in all aspects other than the above.

The carboxyl-modified silicone oil was not sprayed into the flask. The amount of "KBM-3033" manufactured by Shin-Etsu Chemical Co., Ltd. was changed to 5 g. Silica particles PS-5 were obtained by the same method as the method for producing the silica particles PS-1 in all aspects other than the above.

Hydrophilic fumed silica particles ("AEROSIL (registered Japanese trademark) 90G" manufactured by Nippon Aerosil Co., Ltd., number average primary particle diameter: approximately 20 nm) were used as silica particles PS-6.

[Method for Measuring Physical Property Value of Silica Particles]

<Measurement of Hydrophobicity of Silica Particles>

A hydrophobicity was determined for each type of the silica particles (more specifically, the silica particles PS-1 to PS-6) by a methanol wettability method. Specifically, 25 mL of ion exchanged water and 0.1 g of a measurement target (silica particles) were placed in a beaker (capacity: 100 mL) in an air atmosphere at a normal temperature (25° C.) and the beaker contents were stirred at a rotational speed of 100 rpm for 10 minutes using a stirrer. A specific amount of methanol was added into the beaker at a rate of 2 mL/minute. The beaker contents were stirred at a rotational speed of 200 rpm for 30 seconds and whether or not the measurement target was entirely sedimented on the bottom of the beaker was visually checked. Addition of methanol and stirring were repeated until it was confirmed that the measurement target was entirely sedimented. Once it was confirmed that the measurement target was entirely sedimented, a hydrophobicity of the measurement target was calculated based on the following equation. A result of the calculation is shown in Table 3.

$$\text{Hydrophobicity (\%) of measurement target}=100\times \text{addition amount of methanol}/(\text{addition amount of methanol}+\text{amount of ion exchanged water})$$

[Method for Producing Toners]

<Production of Toner TA-1>

An FM mixer ("FM-20B" manufactured by Nippon Coke & Engineering Co., Ltd.) was charged with 80.0 parts by mass of the polyester resin, 9.0 parts by mass of an ester wax ("NISSAN ELECTOL (registered Japanese trademark) WEP-3" manufactured by NOF Corporation), and 9.0 parts by mass of carbon black ("MA100" manufactured by Mitsubishi Chemical Corporation). The contents in the mixer were mixed at a rotational speed of 2,000 rpm for 4 minutes.

The resultant mixture was melt-kneaded using a twin-screw extruder ("PCM-30" manufactured by Ikegai Corp.) under conditions of: a material feeding rate of 8 kg/hour; a shaft rotational speed of 130 rpm; and a set temperature (cylinder temperature) of 110° C. The resultant melt-kneaded product was cooled. The cooled melt-kneaded product was coarsely pulverized using a pulverizer ("ROTOPLEX (registered Japanese trademark)" manufactured by Hosokawa Micron Corporation) under a condition of a set particle diameter of no greater than 2 mm. The resultant coarsely pulverized product was finely pulverized using a pulverizer ("TURBO MILL MODEL RS" manufactured by FREUND-TURBO CORPORATION). The resultant finely pulverized product was classified using a classifier ("ELBOW JET TYPE EJ-LABO" manufactured by Nittetsu Mining Co., Ltd.). Through the above, toner cores having a volume median diameter ($D_{50}$) of 6 μm were obtained. The obtained toner cores had a softening point (Tm) of 89° C. and a glass transition point (Tg) of 48° C.

A three-necked flask (capacity: 1 L) equipped with a thermometer and a stirring impeller was charged with 300 mL of ion exchanged water. The flask was set in a water bath and an internal temperature of the flask was kept at 30° C. using the water bath. A specific amount of an aqueous solution of an oxazoline group-containing macromolecule ("EPOCROS WS-300" manufactured by Nippon Shokubai Co., Ltd., solid concentration: 10% by mass) was added into the flask, and then the flask contents were stirred at a rotational speed of 200 rpm for 1 hour. Further, 300.0 g of the toner cores was added into the flask, and then, the flask contents were stirred at a rotational speed of 200 rpm for 1 hour. Note that the amount of the aqueous solution of the oxazoline group-containing macromolecule was determined such that the amount of an oxazoline group-containing resin was 1% by mass relative to the amount of the toner cores.

Then, 300 mL of ion exchanged water, 6 mL of ammonia water (concentration: 1% by mass), and 0.2 mL of acetic acid were added into the flask in order. An internal temperature of the flask was increased up to 60° C. at a heating rate of 0.5° C./minute while the flask contents were stirred at a rotational speed of 150 rpm. The flask contents were stirred at a rotational speed of 100 rpm for 1 hour while the internal temperature of the flask was kept at 60° C. Thereafter, the internal temperature of the flask was lowered to the normal temperature. Through the above, a dispersion of toner mother particles was obtained.

Suction filtration was performed on the obtained dispersion of the toner mother particles using a Buchner funnel. The resultant wet cake of the toner mother particles was re-dispersed in ion exchanged water. Suction filtration was performed on the resultant dispersion using a Buchner funnel. Solid-liquid separation as above was repeated five times.

The resultant toner mother particles were dispersed in an aqueous ethanol solution (concentration: 50% by mass). As a result, a slurry of the toner mother particles was obtained. The toner mother particles in the slurry were dried using a continuous type surface modifier ("COATMIZER (registered Japanese trademark)" manufactured by Freund Corporation) under conditions of: a hot-air temperature of 45° C.; and a flow rate of 2 $m^3$/minute. Through the above, a plurality of toner mother particles PT-1 was obtained.

An FM mixer ("FM-10B" manufactured by Nippon Coke & Engineering Co., Ltd.) was charged with 100.0 parts by mass of the toner mother particles PT-1, 1.8 parts by mass of the silica particles PS-1, and 1.5 parts by mass of conductive titanium oxide particles ("EC-100" manufactured by Titan Kogyo, Ltd.). The contents in the mixer were mixed under conditions of: a rotational speed of 3,000 rpm; a jacket temperature of 20° C.; and a mixing time of 5 minutes. Through the above, the toner TA-1 including a number of toner particles was obtained.

<Production of Toner TA-2>

Toner mother particles PT-2 were produced by the same method as the method for producing the toner mother particles PT-1 in all aspects other than the following changes. Specifically, the amount of the aqueous solution of the oxazoline group-containing macromolecule was determined such that the amount of the oxazoline group-containing resin was 5% by mass relative to the amount of the toner cores. Also, a dispersion of the toner mother particles was obtained without adding acetic acid into the flask. Thus, the toner mother particles PT-2 were obtained. The toner TA-2 was obtained by the same method as the method for producing the toner TA-1 in all aspects other than that the toner mother particles PT-2 were used instead of the toner mother particles PT-1.

<Production of Toner TA-3>

Toner mother particles PT-3 were produced by the same method as the method for producing the toner mother particles PT-1 in all aspects other than the following changes. Specifically, the amount of the aqueous solution of the oxazoline group-containing macromolecule was determined such that the amount of the oxazoline group-containing resin was 9% by mass relative to the amount of the toner cores. Also, a dispersion of the toner mother particles was obtained without adding acetic acid into the flask. Thus, the toner mother particles PT-3 were obtained. The toner TA-3 was obtained by the same method as the method for producing the toner TA-1 in all aspects other than that the toner mother particles PT-3 were used instead of the toner mother particles PT-1.

<Production of Toners TA-4 to TA-6>

The toners TA-4 to TA-6 were obtained by the same method as the method for producing the toner TA-2 in all aspects other than that the silica particles PS-2 to PS-4 were used in production of the toners TA-4 to TA-6, respectively, instead of the silica particles PS-1.

<Production of Toner TA-7>

Toner mother particles PT-4 were produced by the same method as the method for producing the toner mother particles PT-1 in all aspects other than the following changes. Specifically, the amount of the aqueous solution of the oxazoline group-containing macromolecule was determined such that the amount of the oxazoline group-containing resin was 5% by mass relative to the amount of the toner cores. Also, the amount of acetic acid was changed from 0.2 mL to 2.0 mL. Thus, the toner mother particles PT-4 were obtained. The toner TA-7 was obtained by the same method as the method for producing the toner TA-1 in all aspects other than that the toner mother particles PT-4 were used instead of the toner mother particles PT-1.

<Production of Toner TA-8>

Toner mother particles PT-5 were produced by the same method as the method for producing the toner mother particles PT-1 in all aspects other than the following changes. Specifically, "EPOCROS WS-700" (solid concentration: 25% by mass) manufactured by Nippon Shokubai Co., Ltd. was used instead of "EPOCROS WS-300" manufactured by Nippon Shokubai Co., Ltd. The amount of the aqueous solution of the oxazoline group-containing macromolecule was determined such that the amount of the oxazoline group-containing resin was 2.0% by mass relative to the amount of the toner cores. Thus, the toner mother particles PT-5 were obtained. The toner TA-8 was obtained by the same method as the method for producing the toner TA-1 in all aspects other than that the toner mother particles PT-5 were used instead of the toner mother particles PT-1.

<Production of Toner TB-1>

Toner mother particles PT-6 were produced by the same method as the method for producing the toner mother particles PT-1 in all aspects other than the following changes. Specifically, the amount of the aqueous solution of the oxazoline group-containing macromolecule was determined such that the amount of the oxazoline group-containing resin was 0.7% by mass relative to the amount of the toner cores. Also, the amount of acetic acid was changed from 0.2 mL to 0.5 mL. Thus, the toner mother particles PT-6 were obtained.

The toner mother particles PT-6 were used instead of the toner mother particles PT-1. Also, the silica particles PS-5 were used instead of the silica particles PS-1. The toner TB-1 was obtained by the same method as the method for producing the toner TA-1 in all aspects other than the above.

<Production of Toner TB-2>

Toner mother particles PT-7 were produced by the same method as the method for producing the toner mother particles PT-1 in all aspects other than the following changes. Specifically, the amount of the aqueous solution of the oxazoline group-containing macromolecule was determined such that the amount of the oxazoline group-containing resin was 0.5% by mass relative to the amount of the toner cores. Also, the amount of acetic acid was changed from 0.2 mL to 0.5 mL. Thus, the toner mother particles PT-7 were obtained. The toner TB-2 was obtained by the same method as the method for producing the toner TA-1 in all aspects other than that the toner mother particles PT-7 were used instead of the toner mother particles PT-1.

<Production of Toner TB-3>

Toner mother particles PT-8 were produced by the same method as the method for producing the toner mother particles PT-1 in all aspects other than the following changes. Specifically, the amount of the aqueous solution of the oxazoline group-containing macromolecule was determined such that the amount of the oxazoline group-containing resin was 12.0% by mass relative to the amount of the toner cores. Also, a dispersion of the toner mother particles was obtained without adding acetic acid into the flask. Thus, the toner mother particles PT-8 were obtained. The toner TB-3 was obtained by the same method as the method for producing the toner TA-1 in all aspects other than that the toner mother particles PT-8 were used instead of the toner mother particles PT-1.

<Production of Toner TB-4>

The toner mother particles PT-7 were used instead of the toner mother particles PT-1. Also, the silica particles PS-5 were used instead of the silica particles PS-1. The toner TB-4 was obtained by the same method as the method for producing the toner TA-1 in all aspects other than the above.

<Production of Toner TB-5>

Toner mother particles PT-9 were produced by the same method as the method for producing the toner mother particles PT-1 in all aspects other than the following changes. Specifically, a dispersion of the toner mother particles was obtained without adding the aqueous solution of the oxazoline group-containing macromolecule and acetic acid into the flask. Thus, the toner mother particles PT-9 were obtained. The toner TB-5 was obtained by the same method as the method for producing the toner TA-1 in all aspects other than that the toner mother particles PT-9 were used instead of the toner mother particles PT-1.

<Production of Toner TB-6>

The toner mother particles PT-6 were used instead of the toner mother particles PT-1. Also, the silica particles PS-6 were used instead of the silica particles PS-1. The toner TB-6 was obtained by the same method as the method for producing the toner TA-1 in all aspects other than the above.

[Method for Measuring Physical Property Value of Toners]

<Measurement of Amount of Ring-Unopened Oxazoline Groups>

With respect to each of the toners (more specifically, the toners TA-1 to TA-8 and TB-1 to TB-6), an amount of ring-unopened oxazoline groups included in the toner was measured. Specifically, quantitative analysis by a GC/MS method was performed under the following conditions using a calibration curve based on standard substances. Measurement results are shown in Table 4.

(Gc/Ms Method)

A gas chromatograph mass spectrometer ("GCMS-QP2010 ULTRA" manufactured by Shimadzu Corporation) and a multi-shot pyrolyzer ("FRONTIER LAB MULTI-FUNCTIONAL PYROLYZER (registered Japanese trademark) PY-3030D" manufactured by Frontier Laboratories Ltd.) were used as measuring devices. A column used was a GC column ("AGILENT (registered Japanese trademark) J&W ULTRA INERT CAPILLARY GC COLUMN DB-5 ms" manufactured by Agilent Technologies Japan, Ltd., phase: allylene phase with a polymer main chain strengthened through introduction of allylene into a siloxane polymer, inner diameter: 0.25 mm, film thickness: 0.25 μm, length: 30 m).

(Gas Chromatography)

Carrier gas: helium (He) gas

Carrier flow rate: 1 mL/minute

Vaporizing chamber temperature: 210° C.

Thermal decomposition temperature: heating furnace "600° C.", interface section "320° C."

Heating condition: kept at 40° C. for 3 minutes, increased from 40° C. to 300° C. at a rate of 10° C./minute, and then kept at 300° C. for 15 minutes (Mass Spectrometry)

Ionization method: electron impact (EI) method

Ion source temperature: 200° C.

Interface section temperature: 320° C.

Detection mode: scan (measurement range: 45 m/z to 500 m/z)

[Methods for Evaluating Toners]

Presence of the specific covalent bond was confirmed by the following method. Also, fogging density, image density change rate, developer agglomeration rate, charge decay constant α, and transfer efficiency were evaluated.

<Confirmation of Presence of Specific Covalent Bond>

First, 20 mg of a toner (more specifically, any of the toners TA-1 to TA-8 and TB-1 to TB-6) was dissolved in 1 mL of deuterated chloroform. The resultant solution was placed in a test tube (diameter: 5 mm). The test tube was set in a Fourier transform nuclear magnetic resonance apparatus (FT-NMR, "JNM-AL400" manufactured by JEOL Ltd.). A $^{1}$H-NMR spectrum was measured under conditions of: a sample temperature of 20° C.; and a cumulative number of times of 128. Tetramethylsilane was used as an internal standard substance of chemical shift. Presence of the specific covalent bond was inferred when a triplet signal was observed around a chemical shift δ of 6.5. Results of the measurement are shown in Table 4.

<Measurement of Fogging Density>

First, 100 parts by mass of a carrier (carrier for "TASKa1fa500ci" manufactured by KYOCERA Document Solutions Inc.) and 10 parts by mass of a toner (any of the toners TA-1 to TA-8 and TB-1 to TB-6) were mixed for 30 minutes using a ball mill. Through the above, an evaluation target was obtained.

The evaluation target was loaded into an accommodation section of a development device of a multifunction peripheral ("TASKa1fa500ci" manufactured by KYOCERA Document Solutions Inc.). Also, the toner (more specifically, any of the toners TA-1 to TA-8 and TB-1 to TB-6) was loaded into a toner container of the multifunction peripheral. Thus, an evaluation apparatus was prepared.

An image (printing rate: 5%) was continuously printed on 4,000 sheets of plain paper (A4 size) using the evaluation apparatus in an environment at a temperature of 10° C. and a relative humidity of 10%. Next, an evaluation image (printing rate: 20%) was continuously printed on 500 sheets of plain paper (A4 size) using the evaluation apparatus in an environment at a temperature of 10° C. and a relative humidity of 10%. Thus, 500 evaluation images were obtained. Each of the evaluation images included a solid image portion and a blank portion (region with no print thereon).

A reflection density of the blank portion of each evaluation image was measured using a Macbeth reflection densitometer ("RD914" manufactured by X-Rite Inc.). A fogging density (FD) was calculated based on the following equation. Thus, the fogging density (FD) was determined for each of the obtained evaluation images. Then, an average value of the fogging densities (FD) was obtained as an evaluation value.

$FD$=(reflection density of blank portion)−(reflection density of unprinted paper)

The fogging density (FD) was evaluated in accordance with the following standard. Evaluation results are shown in Table 4.

Excellent (A): Evaluation value was no greater than 0.005.

Mediocre (B): Evaluation value was greater than 0.005 and no greater than 0.010.

Bad (C): Evaluation value was greater than 0.010.

<Measurement of Image Density Change Rate>

An image density change rate was measured using the evaluation apparatus used in <Measurement of Fogging Density> described above. Specifically, a first evaluation image was printed on plain paper (A4 size) using the evaluation apparatus in an environment at a temperature of 23° C. and a relative humidity of 50%. The first evaluation image included a solid image portion and a blank portion (region with no print thereon). A reflection density (ID: image density) of the solid image portion of the first evaluation image was measured using a Macbeth reflection densitometer ("RD914" manufactured by X-Rite Inc.). Thus, an initial image density was obtained.

Next, an image (printing rate: 5%) was continuously printed on 5,000 sheets of plain paper (A4 size) using the evaluation apparatus in an environment at a temperature of 23° C. and a relative humidity of 50%. Thereafter, a second evaluation image was printed on plain paper (A4 size) using the evaluation apparatus in an environment at a temperature of 23° C. and a relative humidity of 50%. The second evaluation image included a solid image portion and a blank portion (region with no print thereon). A reflection density (ID: image density) of the solid image portion of the second evaluation image was measured using a Macbeth reflection densitometer ("RD914" manufactured by X-Rite Inc.). Thus, an image density after continuous printing was obtained. An image density change rate was calculated based on the following equation.

Image density change rate=100×(image density after continuous printing)/(initial image density)

The image density change rate was evaluated in accordance with the following standard. Evaluation results are shown in Table 4.

Good (A): Image density change rate was at least 80% and no greater than 120%.

Bad (B): Image density change rate was smaller than 80% or greater than 120%.

<Measurement of Developer Agglomeration Rate>

A developer agglomeration rate was measured using the evaluation apparatus used in <Measurement of Fogging Density> described above. Specifically, the development device was taken out of the evaluation apparatus and left to stand in a thermostatic apparatus (set temperature: 50° C.) for 1 hour. In the state where the development device was left to stand in the thermostatic apparatus, stirring was performed within the development device for 1 hour using an external motor. Under control by the external motor, stirring within the development device matching a driving speed of the evaluation apparatus was performed. Thereafter, the evaluation target was taken out of the development device.

Then, 10 g of the evaluation target was placed on a 200-mesh sieve (pore size: 75 μm) of a known mass. A mass of the evaluation target on the sieve (mass of the evaluation target before sifting) was determined by measuring a mass of the sieve including the evaluation target placed thereon. The sieve was set in POWDER TESTER (registered Japanese trademark, manufactured by Hosokawa Micron Corporation) and shaken for 60 seconds at a rheostat level of 5 in accordance with a manual of POWDER TESTER. Thus, the evaluation target was sifted. After the sifting, a mass of the evaluation target that had not passed through the sieve was measured. A developer agglomeration rate (unit: %) was determined from the mass of the evaluation target before the sifting and the mass of the evaluation target after the sifting based on the following equation. Note that in the following equation, "mass of evaluation target after sifting" is the mass of the evaluation target that had not passed through the sieve and that had been left on the sieve after the sifting.

Developer agglomeration rate=100×mass of evaluation target after sifting/mass of evaluation target before sifting The developer agglomeration rate was evaluated in accordance with the following standard. Evaluation results are shown in Table 5.

Excellent (A): Developer agglomeration rate was no greater than 2%.

Good (B): Developer agglomeration rate was greater than 2% and no greater than 3%.

Bad (C): Developer agglomeration rate was greater than 3%.

<Measurement of Charge Decay Constant α>

With respect to each of the toners (more specifically, the toners TA-1 to TA-8 and TB-1 to TB-6), a charge decay constant α was measured using an electrostatic diffusivity measurement device ("NS-D100" manufactured by Nano Seeds Corporation) in accordance with a method described in Japanese Industrial Standard (JIS) C 61340-2-1-2006. Specifically, a sample (toner) was placed in a measurement cell. The measurement cell was a metal cell with a recess (inner diameter: 10 mm, depth: 1 mm). The sample was thrusted from above using a slide glass to fill the recess of the cell with the sample. The slide glass was reciprocally moved on a surface of the cell to remove a portion of the sample spilled from the cell. The cell was filled with the sample in an amount of at least 0.04 g and no greater than 0.06 g.

The measurement cell filled with the sample was left to stand for 12 hours in an environment at a temperature of 32.5° C. and a relative humidity of 80%. The measurement cell was grounded and set within the electrostatic diffusivity measurement device. The sample was charged by supplying ions to the sample through corona discharge. Charging was performed for 0.5 seconds. After 0.7 seconds elapsed from termination of the corona discharge, the surface potential of the sample was continuously measured. A charge decay constant (charge decay rate) α was calculated from the measured surface potential based on the following equation: $V=V_0\exp(-\alpha\sqrt{t})$. In the equation, V represents the surface potential [unit: V], $V_0$ represents an initial surface potential [unit:V], and t represents a decay time [unit: second].

The charge decay constant α was evaluated in accordance with the following standard. Evaluation results are shown in Table 5.

Good (A): Charge decay constant α was smaller than 0.030.

Bad (B): Charge decay constant α was equal to or greater than 0.030.

<Measurement of Transfer Efficiency>

The evaluation target was loaded into an accommodation section of a development device of a multifunction peripheral ("TASKalfa5550ci" manufactured by KYOCERA Document Solutions Inc.). Also, the toner (more specifically, any of the toners TA-1 to TA-8 and TB-1 to TB-6) was loaded into a toner container of the multifunction peripheral. Thus, an evaluation apparatus was prepared.

An image (printing rate: 5%) was continuously printed on 10,000 sheets of plain paper (A4 size) using the evaluation apparatus in an environment at a temperature of 32.5° C. and a relative humidity of 80%. The continuous printing was performed together with toner replenishment. After the continuous printing, a mass of consumed toner and a mass of collected toner were measured. The consumed toner is a portion of the toner discharged from the toner container. The collected toner is a portion of the consumed toner that was not transferred to the plain paper. A transfer efficiency (unit: % by mass) was calculated based on the following equation.

Transfer efficiency=100×(mass of consumed toner−mass of collected toner)/(mass of consumed toner)

The transfer efficiency was evaluated in accordance with the following standard. Evaluation results are shown in Table 5.

Excellent (A): Transfer efficiency was at least 90% and no greater than 100%.

Good (B): Transfer efficiency was at least 80% and smaller than 90%.

Bad (C): Transfer efficiency was smaller than 80%.

[Evaluation Results of Toners]

Tables 4 and 5 show evaluation results of the toners. In Table 4, an amount of ring-unopened oxazoline groups included in 1 g of a toner (more specifically, any of the toners TA-1 to TA-8 and TB-1 to TB-6) is shown in the column under "Ring-unopened amount". Also, whether or not a triplet signal was observed around a chemical shift δ of 6.5 in the $^1$H-NMR spectrum is shown in the column under "Presence of specific covalent bond". "Y (Yes)" indicates that the triplet signal was observed and "N (No)" indicates that the triplet signal was not observed.

TABLE 4

| | Toner | Ring-unopened amount (μmol/g) | Presence of specific covalent bond | Fogging density | Image density change rate (%) |
|---|---|---|---|---|---|
| Example 1 | TA-1 | 0.15 | Y | 0.005 (A) | 83 (A) |
| Example 2 | TA-2 | 58 | Y | 0.003 (A) | 91 (A) |
| Example 3 | TA-3 | 81 | Y | 0.001 (A) | 104 (A) |
| Example 4 | TA-4 | 50 | Y | 0.003 (A) | 94 (A) |
| Example 5 | TA-5 | 41 | Y | 0.002 (A) | 97 (A) |
| Example 6 | TA-6 | 51 | Y | 0.002 (A) | 97 (A) |
| Example 7 | TA-7 | 46 | Y | 0.003 (A) | 90 (A) |
| Example 8 | TA-8 | 5 | Y | 0.005 (A) | 85 (A) |
| Comparative Example 1 | TB-1 | 0.11 | N | 0.015 (C) | 72 (B) |
| Comparative Example 2 | TB-2 | 0.08 | Y | 0.010 (B) | 78 (B) |
| Comparative Example 3 | TB-3 | 120 | Y | 0.004 (A) | 92 (A) |
| Comparative Example 4 | TB-4 | 0.08 | N | 0.017 (C) | 67 (B) |
| Comparative Example 5 | TB-5 | 0.00 | N | 0.021 (C) | 60 (B) |
| Comparative Example 6 | TB-6 | 0.11 | N | 0.001 (A) | 65 (B) |

TABLE 5

| | Toner | Developer agglomeration rate (%) | Charge decay constant α | Transfer efficiency (%) |
|---|---|---|---|---|
| Example 1 | TA-1 | 1.9 (A) | 0.014 (A) | 91 (A) |
| Example 2 | TA-2 | 1.7 (A) | 0.018 (A) | 93 (A) |
| Example 3 | TA-3 | 1.5 (A) | 0.026 (A) | 96 (A) |
| Example 4 | TA-4 | 1.6 (A) | 0.020 (A) | 95 (A) |
| Example 5 | TA-5 | 1.6 (A) | 0.025 (A) | 96 (A) |
| Example 6 | TA-6 | 1.5 (A) | 0.025 (A) | 95 (A) |
| Example 7 | TA-7 | 1.9 (A) | 0.016 (A) | 92 (A) |
| Example 8 | TA-8 | 1.8 (A) | 0.017 (A) | 92 (A) |
| Comparative Example 1 | TB-1 | 3.2 (C) | 0.011 (A) | 84 (B) |
| Comparative Example 2 | TB-2 | 2.5 (B) | 0.013 (A) | 86 (B) |
| Comparative Example 3 | TB-3 | 1.8 (A) | 0.036 (C) | 93 (A) |
| Comparative Example 4 | TB-4 | 3.6 (C) | 0.014 (A) | 78 (C) |
| Comparative Example 5 | TB-5 | 4.1 (C) | 0.010 (A) | 75 (C) |
| Comparative Example 6 | TB-6 | 4.0 (C) | 0.072 (C) | 72 (C) |

Each of the toners TA-1 to TA-8 (more specifically, the toners according to Examples 1 to 8) had the above-described basic features. Specifically, each of the toners TA-1 to TA-8 included a plurality of toner particles. Each of the toner particles included a toner mother particle and an external additive. The toner mother particle included a toner core containing a binder resin and a shell layer covering a surface of the toner core. The external additive included a plurality of silica particles. Each of the silica particles was present on a surface of the shell layer and included a silica base having a surface treated with a surface treatment agent. The surface treatment agent included a first treatment agent having a carboxyl group in a molecule thereof. The toner core and each of the silica particles was bonded to each other through the specific covalent bond. An amount of ring-unopened oxazoline groups included in 1 g of the positively chargeable toner as measured by gas chromatography-mass spectrometry was at least 0.10 μmol and no greater than 100 μmol.

As shown in Tables 4 and 5, in image formation using any of the toners TA-1 to TA-8, the fogging density (FD) could be controlled so as to be no greater than a desired value even after the continuous printing and the transfer efficiency equal to or greater than a desired value could be achieved even after the continuous printing. Also, in image formation using any of the toners TA-1 to TA-8, the image density change rate could be controlled so as to be within a desired range. Also, even when a two-component developer including any of the toners TA-1 to TA-8 was preserved at a high temperature for a specific period of time, the developer agglomeration rate could be controlled so as to be no greater than a desired value. Also, with respect to each of the toners TA-1 to TA-8, the charge decay constant α could be controlled so as to be no greater than a desired value.

The toners TB-1 to TB-6 (more specifically, the toners according to Comparative Examples 1 to 6) each did not have the above-described basic features. Specifically, in the toner TB-1, the surface treatment agent did not include the first treatment agent, and presence of the specific covalent bond could not be confirmed. In continuous image formation using the toner TB-1, the fogging density (FD) exceeded the desired value and the image density change rate was lower than the desired range. Also, when a two-component developer including the toner TB-1 was preserved at a high temperature for a specific period of time, the developer agglomeration rate exceeded the desired value.

An amount of ring-unopened oxazoline groups included in 1 g of the toner TB-2 was smaller than 0.10 μmol. In continuous image formation using the toner TB-2, the fogging density (FD) exceeded the desired value and the image density change rate was lower than the desired range.

An amount of ring-unopened oxazoline groups included in 1 g of the toner TB-3 was greater than 100 μmol. The charge decay constant α of the toner TB-3 exceeded the desired value.

In the toner TB-4, the surface treatment agent did not include the first treatment agent, and presence of the specific covalent bond could not be confirmed. Also, an amount of ring-unopened oxazoline groups included in 1 g of the toner TB-4 was smaller than 0.10 μmol. In continuous image formation using the toner TB-4, the fogging density (FD) exceeded the desired value, the image density change rate was lower than the desired range, and the transfer efficiency was lower than the desired value. Also, when a two-component developer including the toner TB-4 was preserved at a high temperature for a specific period of time, the developer agglomeration rate exceeded the desired value.

An amount of ring-unopened oxazoline groups included in 1 g of the toner TB-5 was 0.00 μmol, and presence of the specific covalent bond could not be confirmed. In continuous image formation using the toner TB-5, the fogging density (FD) exceeded the desired value, the image density change rate was lower than the desired range, and the transfer efficiency was lower than the desired value. Also, when a two-component developer including the toner TB-5 was preserved at a high temperature for a specific period of time, the developer agglomeration rate exceeded the desired value.

In the toner TB-6, the surface of the silica base was not treated with a surface treatment agent, and presence of the specific covalent bond could not be confirmed. In continuous image formation using the toner TB-6, the image density change rate was lower than the desired range and the transfer efficiency was lower than the desired value. Also, when a two-component developer including the toner TB-6 was preserved at a high temperature for a specific period of time, the developer agglomeration rate exceeded the desired value. Further, the charge decay constant α of the toner TB-6 exceeded the desired value.

What is claimed is:

1. A positively chargeable toner comprising a plurality of toner particles, wherein each of the toner particles includes a toner mother particle and an external additive, the toner mother particle includes a toner core containing a binder resin and a shell layer covering a surface of the toner core, the external additive includes a plurality of silica particles, each of the silica particles is present on a surface of the shell layer and includes a silica base having a surface treated with a surface treatment agent, the surface treatment agent includes a first treatment agent having a carboxyl group in a molecule thereof, the toner core and each of the silica particles are bonded to each other through a covalent bond within the shell layer, the covalent bond includes a first amide bond and a second amide bond, the shell layer contains a vinyl resin, the vinyl resin includes a constitutional unit represented by a formula (1-1) shown below, a constitutional unit represented by a formula (1-2) shown below, and a constitutional unit represented by a formula (1-3) shown below, an amide bond included in the constitutional unit represented by the formula (1-1) is the first amide bond, an amide bond included in the constitutional unit represented by the formula (1-2) is the second amide bond, and an amount of ring-unopened oxazoline groups included in 1 g of the positively chargeable toner as measured by gas chromatography-mass spectrometry is at least 0.10 μmol and no greater than 100 μmol, (1-1)

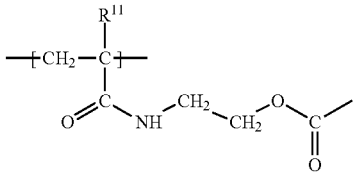

where in the formula (1-1), $R^{11}$ represents a hydrogen atom or an alkyl group optionally substituted with a substituent, and an available bond of a carbon atom bonded to two oxygen atoms is connected to an atom of the binder resin, (1-2)

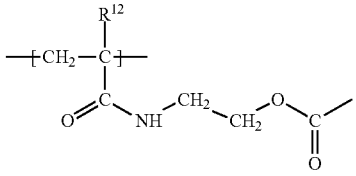

in the formula (1-2), $R^{12}$ represents a hydrogen atom or an alkyl group optionally substituted with a substituent, and an available bond of a carbon atom bonded to two oxygen atoms is connected to an atom of the first treatment agent, (1-3)

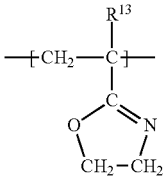

in the formula (1-3), $R^{13}$ represents a hydrogen atom or an alkyl group optionally substituted with a substituent.

2. The positively chargeable toner according to claim 1, wherein the silica particles has a hydrophobicity of at least 60%.

3. The positively chargeable toner according to claim 2, wherein the surface treatment agent further includes a second treatment agent, and the second treatment agent is a hydrophobizing agent.

4. The positively chargeable toner according to claim 3, wherein the first treatment agent is a reactive silicone oil having a carboxyl group in a molecule thereof, and the second treatment agent is an alkoxysilane having an alkyl group in a molecule thereof.

5. The positively chargeable toner according to claim 4, wherein the surface treatment agent further includes a third treatment agent, and the third treatment agent is an alkoxysilane having an amino group in a molecule thereof.

6. The positively chargeable toner according to claim 5, wherein the alkoxysilane having an amino group in a molecule thereof includes an alkoxysilane represented by a formula (6-1) shown below, (6-1)

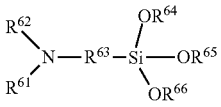

where in the formula (6-1), $R^{61}$ and $R^{62}$ each represent, independently of each other, a hydrogen atom or an alkyl group optionally substituted with a substituent, $R^{63}$ represents an alkylene group optionally substituted with a substituent, and $R^{64}$, $R^{65}$, and $R^{66}$ each represent, independently of one another, an alkyl group optionally substituted with a substituent.

7. The positively chargeable toner according to claim 4, wherein the reactive silicone oil having a carboxyl group in a molecule thereof includes at least one of a carboxyl-modified silicone oil represented by a formula (2-1) shown below, a carboxyl-modified silicone oil represented by a formula (3-1) shown below, and a carboxyl-modified silicone oil represented by a formula (4-1) shown below, (2-1)

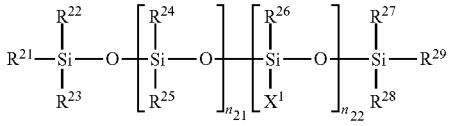

where in the formula (2-1), $R^{21}$ to $R^{29}$ each represent, independently of one another, an alkyl group optionally substituted with a substituent, $n_{21}$ and $n_{22}$ each represent, independently of each other, an integer of at least 1, and $X^1$ represents —R—COOH, where R represents an alkylene group optionally substituted with a substituent, (3-1)

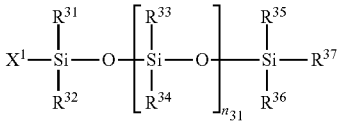

(4-1)

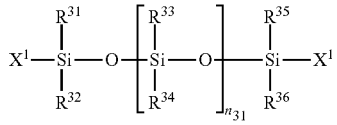

in the formulas (3-1) and (4-1), $R^{31}$ to $R^{37}$ each represent, independently of one another, an alkyl group optionally substituted with a substituent, $n_{31}$ represents an integer of at least 1, and $X^1$ represents —R—COOH, where R represents an alkylene group optionally substituted with a substituent, and in the formula (4-1), two $X^1$ may be the same as or different from each other.

8. The positively chargeable toner according to claim 4, wherein the alkoxysilane having an alkyl group in a molecule thereof includes an alkoxysilane represented by a formula (5-1) shown below, (5-1)

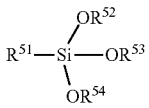

where in the formula (5-1), $R^{51}$ represents an alkyl group optionally substituted with a substituent, and $R^{52}$, $R^{53}$, and $R^{54}$ each represent, independently of one another, a hydrogen atom or an alkyl group optionally substituted with a substituent.

9. The positively chargeable toner according to claim 1, wherein the binder resin includes at least one resin having an acid value of at least 5 mgKOH/g and no greater than 50 mgKOH/g.

10. The positively chargeable toner according to claim 1, wherein the vinyl resin further includes a constitutional unit represented by a formula (1-5) shown below, (1-5)
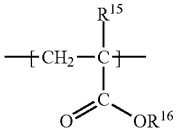
where in the formula (1-5), $R^{15}$ represents a hydrogen atom or a methyl group, and $R^{16}$ represents an alkyl group optionally substituted with a substituent.
* * * * *